US006347833B1

(12) United States Patent
Chen

(10) Patent No.: US 6,347,833 B1
(45) Date of Patent: Feb. 19, 2002

(54) HIGH CHAIR HAVING A SEAT-TILTING MECHANISM

(75) Inventor: Jueh-Cheng Chen, Tainan (TW)

(73) Assignee: Trident Company Ltd., Tainan (TW)

( * ) Notice: Subject to any disclaimer, the term of this patent is extended or adjusted under 35 U.S.C. 154(b) by 0 days.

(21) Appl. No.: 09/658,789

(22) Filed: Sep. 11, 2000

(51) Int. Cl.[7] ..... A47C 1/02
(52) U.S. Cl. ..... 297/328; 297/326; 297/327
(58) Field of Search ..... 297/326, 327, 297/328, 344.14, 344.18

(56) References Cited

U.S. PATENT DOCUMENTS

| | | | | |
|---|---|---|---|---|
| 2,779,389 | A | 1/1957 | Pearl | 297/327 |
| 4,231,612 | A | 11/1980 | Meeker | 297/250 |
| 4,979,773 | A | 12/1990 | Eubank | 296/65.1 |
| 5,364,137 | A | 11/1994 | Shimer | 297/327 |
| 5,527,096 | A | 6/1996 | Shimer | 297/327 |

*Primary Examiner*—Carl D. Friedman
*Assistant Examiner*—Dennis L. Dorsey

(74) *Attorney, Agent, or Firm*—Harness, Dickey & Pierce, P.L.C.

(57) ABSTRACT

A chair includes a leg unit with left and right sides, and a generally L-shaped seat member connected pivotally to the leg unit and swingable about a horizontal axis. The seat member has left and right sides. A seat-tilting mechanism includes a pair of movable plates disposed respectively, vertically and movably on the left and right sides of the leg unit and connected fixedly to each other. Each of the movable plates has an upper edge which is formed with a row of pin notches that are arranged one behind another. An aligned pair of engaging pins is mounted respectively and fixedly to the left and right sides of the seat member. A biasing unit biases the movable plates upward so as to engage a selected one of the notches in each of the movable plates with a respective one of the pins, thereby positioning the seat member with respect to the leg unit. The movable plates can be pulled forcibly and downwardly against biasing action of the biasing unit so as to remove the movable plates from the pins, thereby permitting rotation of the seat member on the leg unit and engagement of each of the engaging pins with another one of the notches in a respective one of the movable plates for forming an inclination angle of the seat member with respect to the leg unit.

7 Claims, 4 Drawing Sheets

HIGH CHAIR HAVING A SEAT-TILTING MECHANISM

BACKGROUND OF THE INVENTION

1. Field of the Invention

The invention relates to a chair, more particularly to a high chair that is provided with a seat-tilting mechanism such that a seat member can be tilted relative to a leg unit.

2. Description of the Related Art

A conventional high chair includes a leg unit and a generally L-shaped seat member fixed on the leg unit for seating of an infant thereon.

A drawback of the aforesaid conventional high chair resides in that the seat member cannot be tilted relative to the leg unit, thereby restricting the range of use of the high chair.

SUMMARY OF THE INVENTION

The main object of this invention is to provide a high chair which is installed with a seat-tilting mechanism such that a seat member can be tilted relative to a leg unit.

Accordingly, a chair of the present invention includes a leg unit with left and right sides, and a generally L-shaped seat member connected pivotally to the leg unit and swingable about a horizontal axis. The seat member has a left side and a right side. A seat-tilting mechanism includes a pair of movable plates which are disposed respectively, vertically and movably on the left and right sides of the leg unit and which are connected fixedly to each other. Each of the movable plates has an upper edge that is formed with a row of pin notches arranged one behind another. An aligned pair of engaging pins are mounted respectively and fixedly to the left and right sides of the seat member. A biasing unit biases the movable plates upward so as to engage a selected one of the pin notches in each of the movable plates with a respective one of the engaging pins, thereby positioning the seat member relative to the leg unit. The movable plates can be pulled forcibly and downwardly against biasing action of the biasing unit so as to remove the movable plates from the engaging pins, thereby permitting rotation of the seat member on the leg unit and engagement of each of the engaging pins with another one of the pin notches in a respective one of the movable plates for forming an inclination angle of the seat member with respect to the leg unit.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
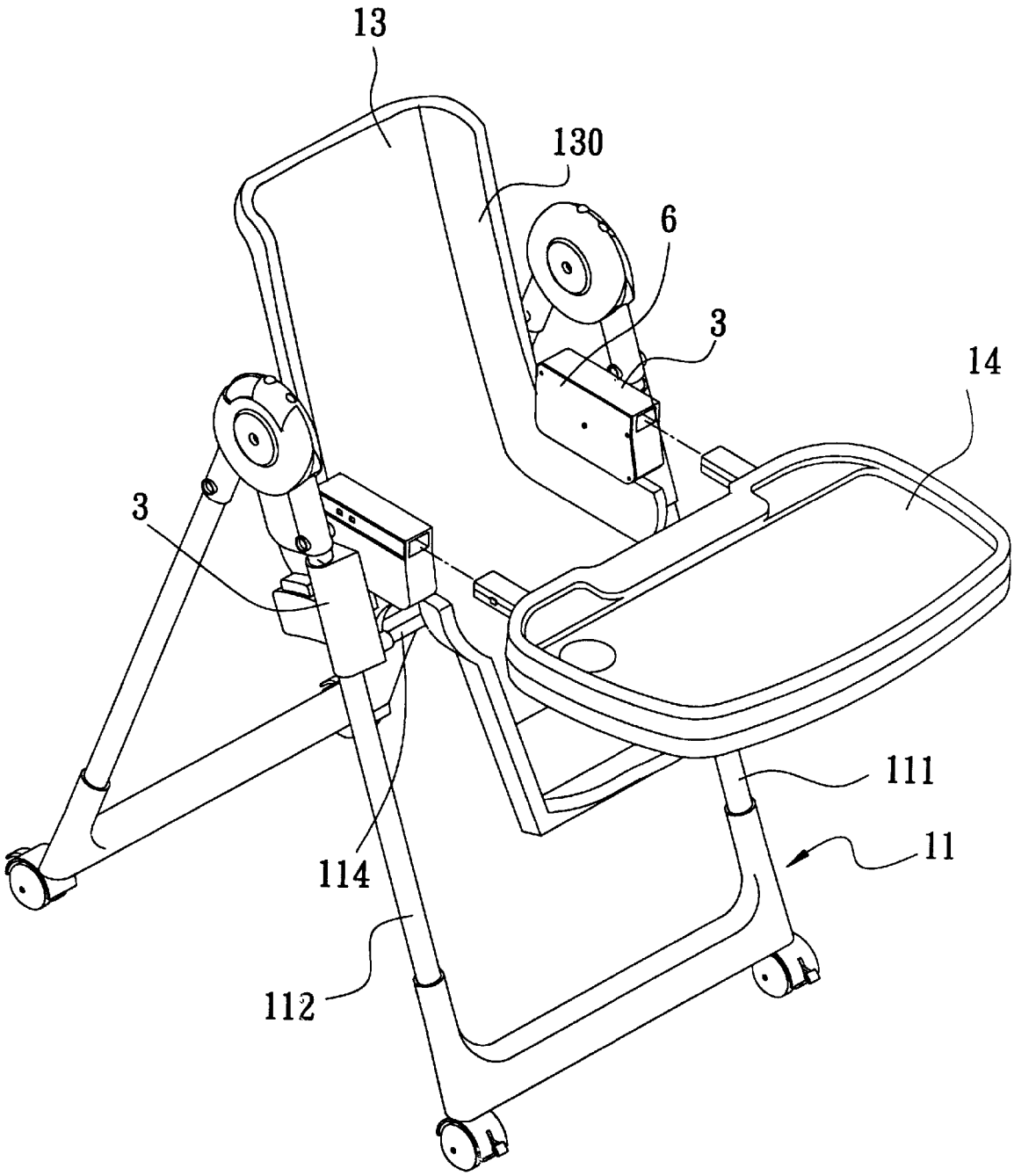
FIG. 1 is a partly exploded perspective view of a preferred embodiment of a chair according to this invention.
Figure 2:
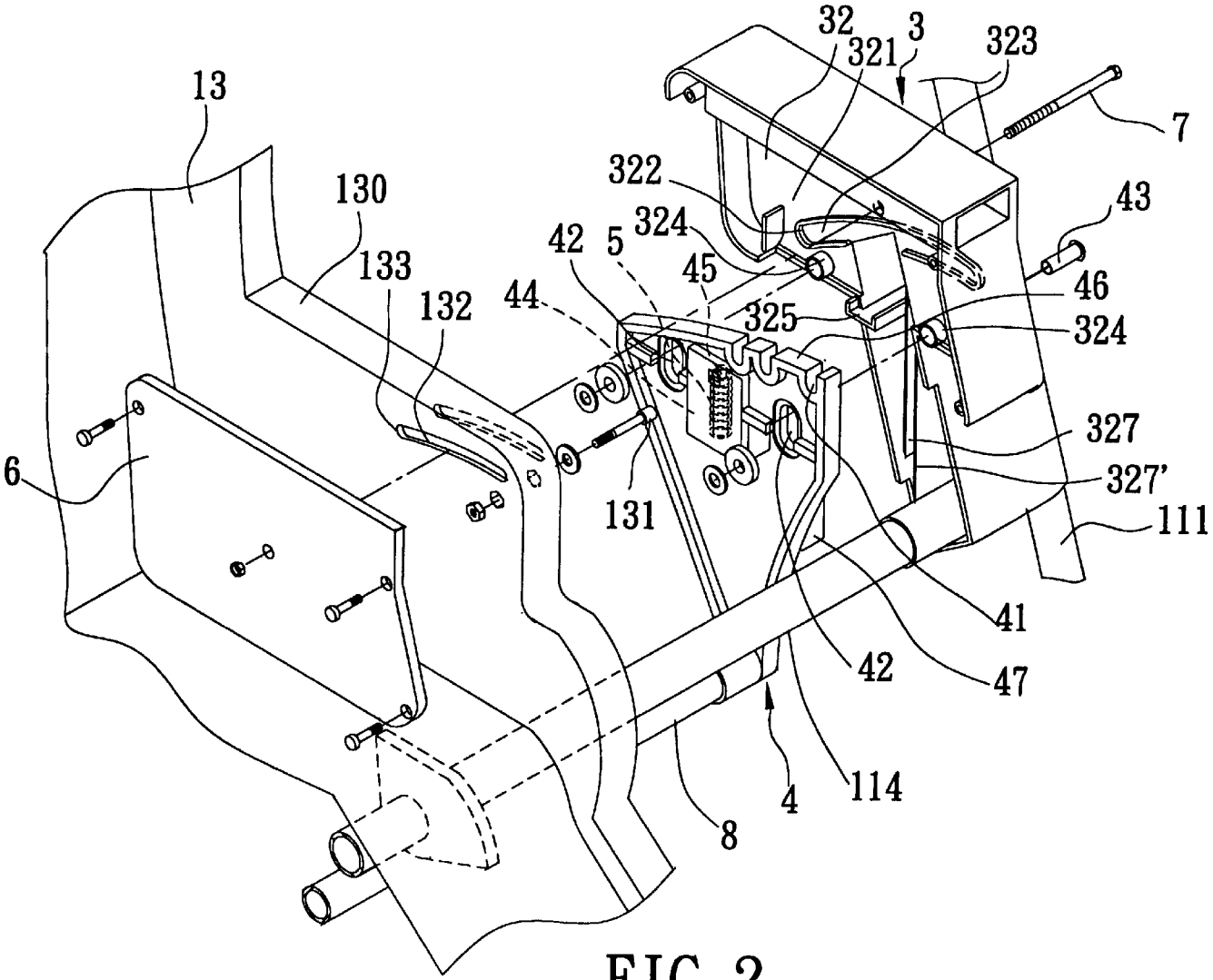
FIG. 2 is a fragmentary exploded view of a seat member and a leg unit of the preferred embodiment.

Referring to FIGS. 1 and 2, the preferred embodiment of a high chair according to the present invention is shown to include a leg unit 11 with left and right sides 111, 112, a generally L-shaped seat member 13, and a seat-tilting mechanism 3. Since the feature of the present invention does not reside in the construction of the leg unit 11, a detailed description of the same is omitted herein for the sake of brevity.

As illustrated, the seat member 13 is connected pivotally to the leg unit 11, and is swingable about a horizontal axis 114, which is in the form of a shaft fixed on the leg unit 11. The seat member 13 has left and right sides 130 (see FIG. 2).

The seat-tilting mechanism 3 includes a pair of movable plates 4, an aligned pair of engaging pins 131, and a biasing unit. The movable plates 4 are disposed respectively, vertically and movably on the left and right sides 111,112 of the leg unit 11, and are connected fixedly to each other. Each of the movable plates 4 has an upper edge 46 which is formed with a row of three pin notches 41 that are arranged one behind another. The engaging pins 131 are mounted respectively and fixedly to the left and right sides 130 of the seat member 13. The biasing unit biases the movable plates 4 upward so as to engage a selected one of the pin notches 41 in each of the movable plates 4 with a respective one of the engaging pins 131, thereby positioning the seat member 13 with respect to the leg unit 11.

Figure 4:
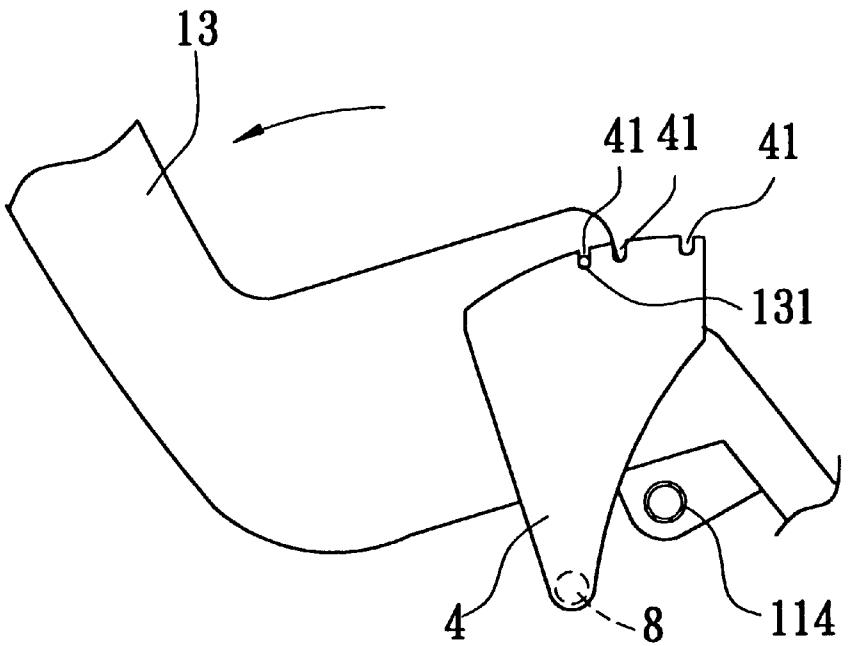
FIG. 4 is a schematic side view of the preferred embodiment, illustrating how the seat member is tilted with respect to the leg unit by removing the movable plate from the seat member.
Figure 3:
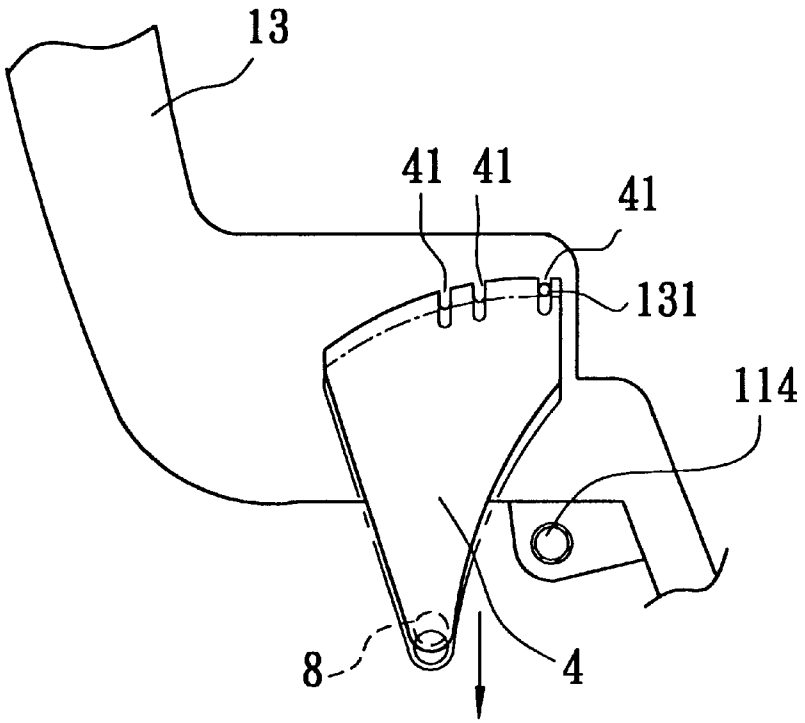
FIG. 3 is a schematic side view of the preferred embodiment, illustrating how a movable plate is removed from the seat member.

The movable plates 4 can be pulled forcibly and downwardly against the biasing action of the biasing unit, as best shown in FIG. 3, so as to remove the movable plates 4 from the engaging pins 131, thereby permitting rotation of the seat member 13 on the leg unit 11 about the horizontal axis 114 and engagement of each of the engaging pins 131 with another one of the pin notches 41 in a respective one of the movable plates 4 for forming an inclination angle of the seat member 13 with respect to the leg unit 11. An important aspect to note is that, after removal of the movable plates 4 from the engaging pins 131 of the seat member 13, the seat member 13 must be manually pushed, in the arrow direction as best shown in FIG. 4, for tilting the seat member 13 relative to the leg unit 11.

The seat-tilting mechanism 3 further includes a connecting rod 8 which interconnects lower ends of the movable plates 4 fixedly such that the movable plates 4 move synchronously therewith. Each of the movable plates 4 has an upper portion formed with two vertical short slide slots 42 that are arranged one behind another. Each of the left and right sides 111,112 of the leg unit 11 includes two fixed horizontal rods 43, each of which is received slidably within a respective one of the short slide slots 42, thereby limiting vertical movement of the movable plates 4 on the leg unit 11.

Each of the left and right sides 111,112 of the leg unit 11 further includes a fixed vertical mounting plate 32 and an adjacent pair of slot-defining plates 327 which are fixed on the mounting plate 32 and which extend perpendicularly from the mounting plate 32 so as to define a vertical long slide slot 327' therebetween. Each of the movable plates 4 has a fixed vertical sliding plate 47 which is received slidably within the long slide slot 327', thereby facilitating smooth vertical movement of the movable plates 4 on the leg unit 11. The horizontal rods 43 are fixed on two rod-retention seats 324 which are formed on the vertical mounting plate 32 at two sides of the long slide slot 327'.

Each of the movable plates 4 has a side surface that faces the vertical mounting plate 32 and that is formed with a spring-accommodating chamber 44 between adjacent two of the short slide slots 42, and a vertical spring-mounting rod 45 which has an upper end that is formed integrally therewith, and a lower end that extends into an upper end portion of the spring-accommodating chamber 44. Each of the left and right sides 111,112 of the leg unit 11 further includes a U-shaped plate 325 fixed on the mounting plate 32 in such a manner that the plate 325 extends into the spring-accommodating chamber 44 in a respective one of the movable plates 4 and is disposed under a respective one of the spring-mounting rods 45. The biasing unit includes two coiled compression springs 5, each of which has an upper portion that is sleeved around a respective one of the spring-mounting rods 45, and a lower end that rests on a respective one of the U-shaped plates 325, thereby biasing a respective one of the movable plates 4 in an upward direction.

In this embodiment, each of the left and right sides 130 of the seat member 13 is further formed with a curved limiting slot 132 (see FIG. 2) which has two closed ends 133 and a predetermined length. Each of the left and right sides 111,112 of the leg unit 11 includes a horizontal limiting pin 7 that is fixed on a respective one of the vertical mounting plates 32 and that is received slidably within a respective one of the limiting slots 132 in the seat member 13, thereby limiting rotational angle of the seat member 13 with respect to the leg unit 11.

Preferably, the upper edge 46 of each of the movable plates 4 has a row of ridges. Each adjacent pair of the ridges defines one of the pin notches 41 therebetween. Each of the vertical mounting plates 32 has an inner side surface 321 which is formed integrally with a curved rib unit 322 that defines a curved slot unit 323 for limiting sliding movement of an end of a respective one of the engaging pins 131 therewithin. The slot unit 323 has a predetermined width so as to prevent flexion of the engaging pins 131 when the ridges of the movable plates 4 push the engaging pins 131 upwardly so as to remove the engaging pins 131 from the pin notches 41 due to deflection of the engaging pins 131 from the selected pin notches 41 during inclination angle adjustment of the seat member 13.

Figure 5:
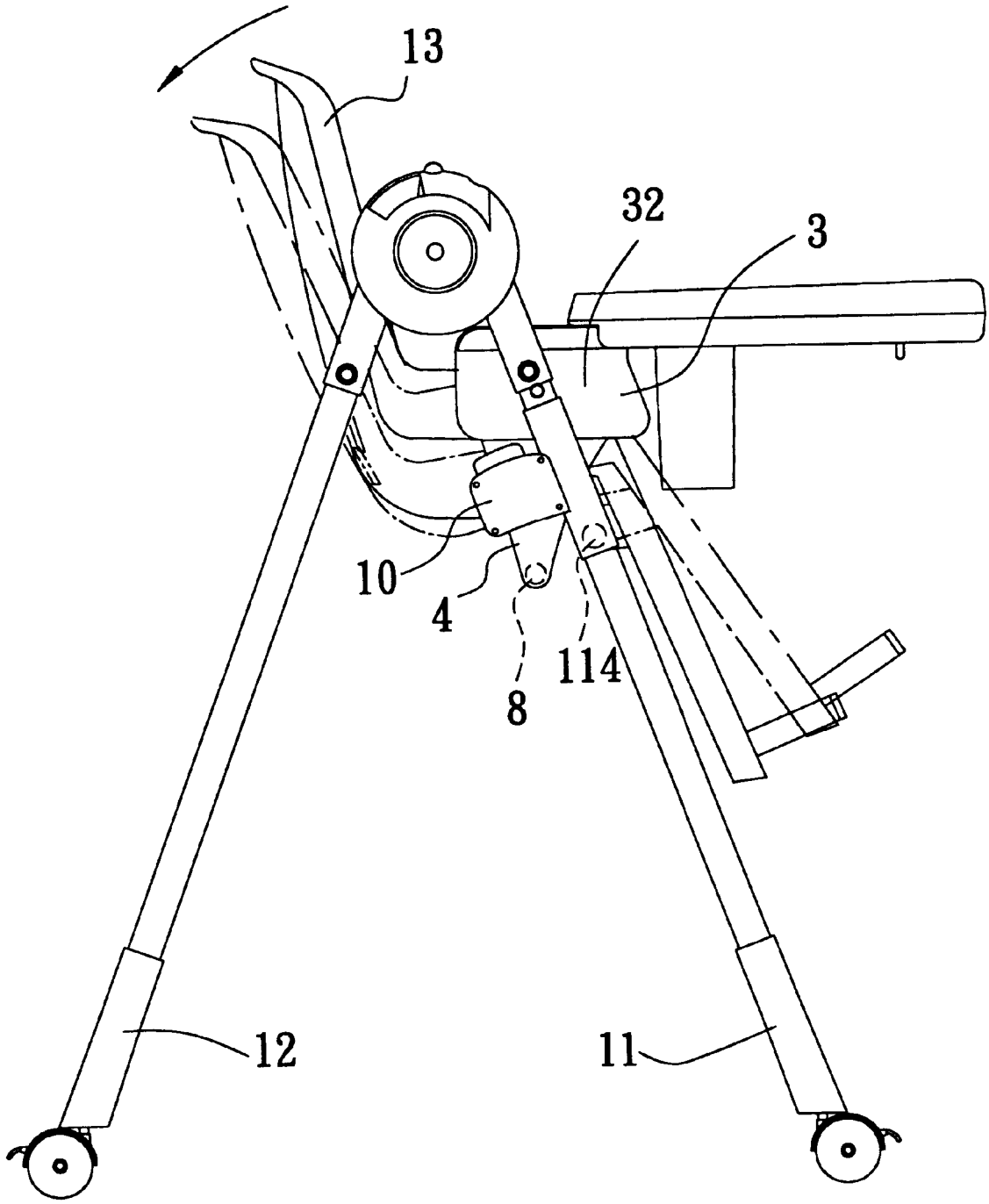
FIG. 5 shows a side view of the preferred embodiment, in which the dotted lines illustrate a tilted position of the seat member.

Each of the vertical mounting plates 32 is preferably formed as a laterally and downwardly opening casing which has an upper portion defining a tray-retention hole therein such that a tray member 14 can be detachably mounted on the casing 32, and an intermediate portion into which a respective one of the left and right sides 130 of the seat member 13 and a respective one of the movable plates 4 extend. A decorative cover 6 is provided so as to cover the lateral opening of the casing 32 so as to conceal the respective side 130 of the seat member 13 and the movable plate 4 in the casing 32. The seat member 13 is further provided with a height adjustment mechanism 10 (see FIG. 5) for adjusting vertical height thereof with respect to the leg unit 11. Since structure of the height adjustment mechanism 10 is not pertinent to the present invention, a detailed description of the same is omitted herein for the sake of brevity.

With this invention thus explained, it is apparent that numerous modifications and variations can be made without departing from the scope and spirit of this invention. It is therefore intended that this invention be limited only as indicated in the appended claims.

I claim:

1. A chair comprising:

a leg unit having a left side and a right side;

a generally L-shaped seat member connected pivotally to said leg unit and swingable about a horizontal axis, said seat member having a left side and a right side; and a seat-tilting mechanism including a pair of movable plates disposed respectively, vertically and movably on said left and right sides of said leg unit and connected fixedly to each other, each of said movable plates having an upper edge which is formed with a row of pin notches that are arranged one behind another, an aligned pair of engaging pins mounted respectively and fixedly to said left and right sides of said seat member, and a biasing unit for biasing said movable plates upwardly so as to engage a selected one of said pin notches in each of said movable plates with a respective one of said engaging pins, thereby positioning said seat member relative to said leg unit, said movable plates being capable of being pulled forcibly and downwardly against biasing action of said biasing unit so as to remove said movable plates from said engaging pins, thereby permitting rotation of said seat member on said leg unit and engagement of each of said engaging pins with another one of said pin notches in a respective one of said movable plates for forming an inclination angle of said seat member with respect to said leg unit.

2. The chair as defined in claim 1, wherein said seat-tilting mechanism further includes a connecting rod which interconnects lower ends of said movable plates fixedly.

3. The chair as defined in claim 2, wherein each of said movable plates has an upper portion formed with two vertical short slide slots that are arranged one behind another, each of said left and right sides of said leg unit including two fixed horizontal rods, each of which is received slidably within a respective one of said short slide slots, thereby limiting vertical movement of said movable plates on said leg unit.

4. The chair as defined in claim 3, wherein each of said left and right sides of said leg unit further includes a fixed vertical mounting plate, an adjacent pair of slot-defining plates fixed on and extending perpendicularly from said mounting plate so as to define a vertical long slide slot therebetween, each of said movable plates having a fixed vertical sliding plate which is received slidably within said long slide slot, thereby facilitating smooth vertical movement of said movable plates on said leg unit.

5. The chair as defined in claim 4, wherein each of said movable plates has a side surface that is formed with a spring accommodating chamber, and a vertical spring-mounting rod which has an upper end that is formed integrally therewith, and a lower end that extends into an upper end portion of said spring accommodating chamber, each of said left and right sides of said leg unit further including a U-shaped plate that is fixed on said mounting plate and extending into said spring accommodating chamber in a respective one of said movable plates and that is disposed under a respective one of said vertical spring-mounting rods, said biasing unit including two coiled compression springs, each of which has an upper portion that is sleeved on a respective one of said spring-mounting rods, and a lower end that rests on a respective one of said U-shaped plates.

6. The chair as defined in claim 4, wherein each of said left and right sides of said seat member is formed with a curved limiting slot that has two closed ends and that has a predetermined length, each of said left and right sides of said leg unit including a horizontal limiting pin that is fixed on said mounting plate and that is received slidably within a respective one of said limiting slots in said seat member, thereby limiting rotational angle of said seat member with respect to said leg unit.

7. The chair as defined in claim 4, wherein said upper edge of each of said movable plates has a row of ridges, each adjacent pair of said ridges defining one of said notches therebetween, each of said vertical mounting plates in a respective one of said left and right sides of said leg unit having an inner side surface which is formed with a curved rib unit that defines a curved slot unit for limiting sliding movement of an end of a respective one of said engaging pins therewithin, said slot units having a predetermined width so as to prevent flexion of said engaging pins when said ridges of said movable plates push said ends of said engaging pins upwardly due to deflection of said engaging pins from all of said pin notches during inclination angle adjustment of said seat member.

* * * * *